US008510873B2

(12) United States Patent
Kim et al.

(10) Patent No.: US 8,510,873 B2
(45) Date of Patent: Aug. 20, 2013

(54) UPPER BODY SUPPORT APPARATUS FOR TOILETS

(76) Inventors: Dae Youn Kim, Seoul (KR); Min Young Park, Seoul (KR)

( * ) Notice: Subject to any disclaimer, the term of this patent is extended or adjusted under 35 U.S.C. 154(b) by 746 days.

(21) Appl. No.: 12/602,657

(22) PCT Filed: May 30, 2008

(86) PCT No.: PCT/KR2008/003064
§ 371 (c)(1),
(2), (4) Date: Jun. 5, 2010

(87) PCT Pub. No.: WO2008/147145
PCT Pub. Date: Dec. 4, 2008

(65) Prior Publication Data

US 2010/0293705 A1 Nov. 25, 2010

(30) Foreign Application Priority Data

Jun. 1, 2007 (KR) ..... 10-2007-0053974

(51) Int. Cl.
*E03D 11/00* (2006.01)

(52) U.S. Cl.
USPC ..... 4/254

(58) Field of Classification Search
IPC ..... A47K 13/00,17/00, 17/02
See application file for complete search history.

(56) References Cited

U.S. PATENT DOCUMENTS 6,904,622 B1 * 6/2005 Gabriel ..... 4/237

FOREIGN PATENT DOCUMENTS

| | | | |
|---|---|---|---|
| JP | 2005-052323 | | 3/2005 |
| JP | 2006-198111 | | 8/2006 |
| JP | 2006198111 | * | 8/2006 |
| KR | 20-0263426 | | 1/2002 |
| KR | 20-0390267 | | 7/2005 |
| KR | 200390267 | * | 7/2005 |
| KR | 20-0420409 | | 6/2006 |
| KR | 200420409 | * | 6/2006 |

OTHER PUBLICATIONS

International Search Report for PCT/KR2008/003063 issued Nov. 14, 2008.
International Search Report for PCT/KR2008/003064 issued Nov. 14, 2009.

* cited by examiner

*Primary Examiner* — Lori Baker
(74) *Attorney, Agent, or Firm* — Christopher Paul Mitchell

(57) ABSTRACT

An upper body support apparatus for toilets which enables a user to place his/her arms thereon when having a bowel movement. The upper body support apparatus includes a support board, which supports the arms of the user thereon, and a horizontal shaft, which provides a path, along which the support board slides relative to the horizontal shaft. The upper body support apparatus further includes a hinge unit, which supports a first end of the horizontal shaft such that the horizontal shaft is rotatable upwards or downwards within an angular range of 90° around the first end thereof, and a vertical frame, which supports the hinge unit and receives therein a drive unit, which rotates the hinge unit to the left or the right or moves the hinge unit upwards or downwards.

22 Claims, 11 Drawing Sheets

UPPER BODY SUPPORT APPARATUS FOR TOILETS

RELATED APPLICATIONS

This application is a 371 application of International Application No. PCT/KR2008/003064, filed May 30, 2008, which in turn claims priority from Korean Patent Application No. 10-2007-0053974, filed Jun. 1, 2007, both of which are incorporated herein by reference in their entirety.

TECHNICAL FIELD

The present invention relates an upper body support apparatus for supporting the upper body of a user who sit on a toilet.

BACKGROUND ART

Generally, when most users sit on toilets and have bowel movements, they bend their upper bodies forwards and place the arms on the legs.

However, such a posture makes the users develop bad habits, in other words, assume bad posture unconsciously in daily life. Furthermore, such a posture has a bad influence on bowel evacuation.

Furthermore, in the case where the users strain to evacuate their bowels in the above posture, there is a problem in that blood pressure is increased, thus negatively affecting the body.

Recently, the number of constipated persons has markedly increased attributable to excessive stress and attempts to lose weight. In the case of such constipated persons, due to anxiety when having bowel movements, it becomes still more difficult to have smooth bowel movements.

In particular, if there were a separate apparatus which enabled people to conduct other routine work for the several minutes for which the persons have bowel movements, it would be a great help to people with busy lives.

To achieve this purpose and overcome the above-mentioned problems, an upper body support board for toilets was proposed in Korean Utility Model Registration No. 390267 (application date: Apr. 14, 2005, registration date: Jul. 11, 2007), which was filed by the applicant of the present invention. The conventional upper body support board includes a support board to support the arms of a user thereon, a support rod, which is coupled to the support board to support the support board, and a mounting rod, into which the support rod is inserted so as to be rotatable relative to the mounting rod within a predetermined angular range, and which is installed in a lavatory to position the support board and the support rod at a predetermined position in the lavatory.

In the case of the upper body support board disclosed by the applicant of the present invention, samples have already been developed, and the commercialization thereof has been conducted. Furthermore, there was a very positive response. Particularly, the upper body support board evoked a good response from the old and the weak. However, in the case of the conventional upper body support board, the support board is relatively heavy, so that it is difficult for the old or the weak to lift or push the support board. Furthermore, there is a disadvantage in that, in the winter, when a user places his/her arms on the upper body support board, the user may feel a chill due to the cooled support board. Therefore, a solution to these problems is required.

DISCLOSURE OF INVENTION

Technical Problem

Accordingly, the present invention has been made keeping in mind the above problems occurring in the prior art, and an object of the present invention is to provide an upper body support apparatus for toilets which enables a user to place his/her arms thereon when having a bowel movement, and is constructed such that free movement of the user in a lavatory having limited space is ensured, opening or closing of a door of the lavatory is not impeded, and the height of the apparatus is adjustable in response to the height of the user, and which has a function of providing heat to maintain the body temperature of the user in the winter and a vibration function to stimulate the abdomen of the user to promote bowel evacuation.

Technical Solution

In order to accomplish the above object, the present invention provides an upper body support apparatus for toilets provided at a predetermined position adjacent to a toilet in a lavatory to support an upper body of a user who sits on the toilet, the upper body support apparatus including: a support board to support the arms of the user thereon; a horizontal shaft for providing a path, along which the support board slides relative to the horizontal shaft; a hinge unit for supporting the first end of the horizontal shaft such that the horizontal shaft is rotatable upwards or downwards within an angular range of 90° around the first end thereof; and a vertical frame for supporting the hinge unit and receiving therein a drive unit, which rotates the hinge unit to the left or right or moves the hinge unit upwards or downwards in a one-touch button control manner. e the abdomen of the user to promote bowel evacuation.

Advantageous Effects

In an upper body support apparatus for toilets according to the present invention, a user can place his/her arms on a support board while having the bowel movement, thus maintaining correct posture such that the upper body of the user is prevented from leaning too far forwards, thereby preventing an increase in blood pressure attributable to the bowel movement.

Furthermore, under normal conditions, the support board can be placed adjacent to a wall in an upright state or in a horizontal state. Hence, in a lavatory having limited space, free movement of the user is ensured, and the upper body support apparatus is prevented from impeding the opening or closing of a door of the lavatory.

As well, in the present invention, the support board can be automatically rotated downwards or upwards and is thus opened or closed by manipulating control buttons in a one-touch button control manner. Therefore, even the old and the weak can easily use the upper body support apparatus.

BEST MODE FOR CARRYING OUT THE INVENTION

Hereinafter, the present invention will be described in detail with reference to the attached drawings.

Figure 1:
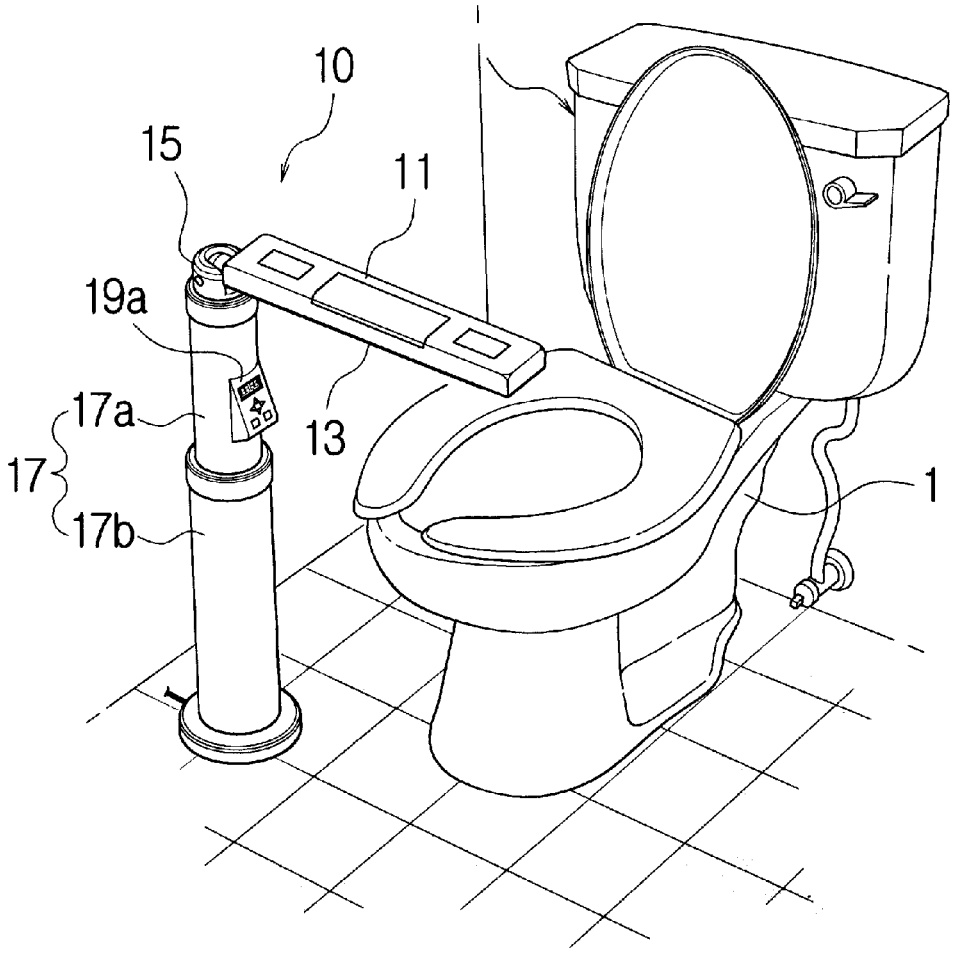
FIG. 1 is a perspective view illustrating an upper body support apparatus provided adjacent to a toilet in a lavatory, according to an embodiment of the present invention.
Figure 2:
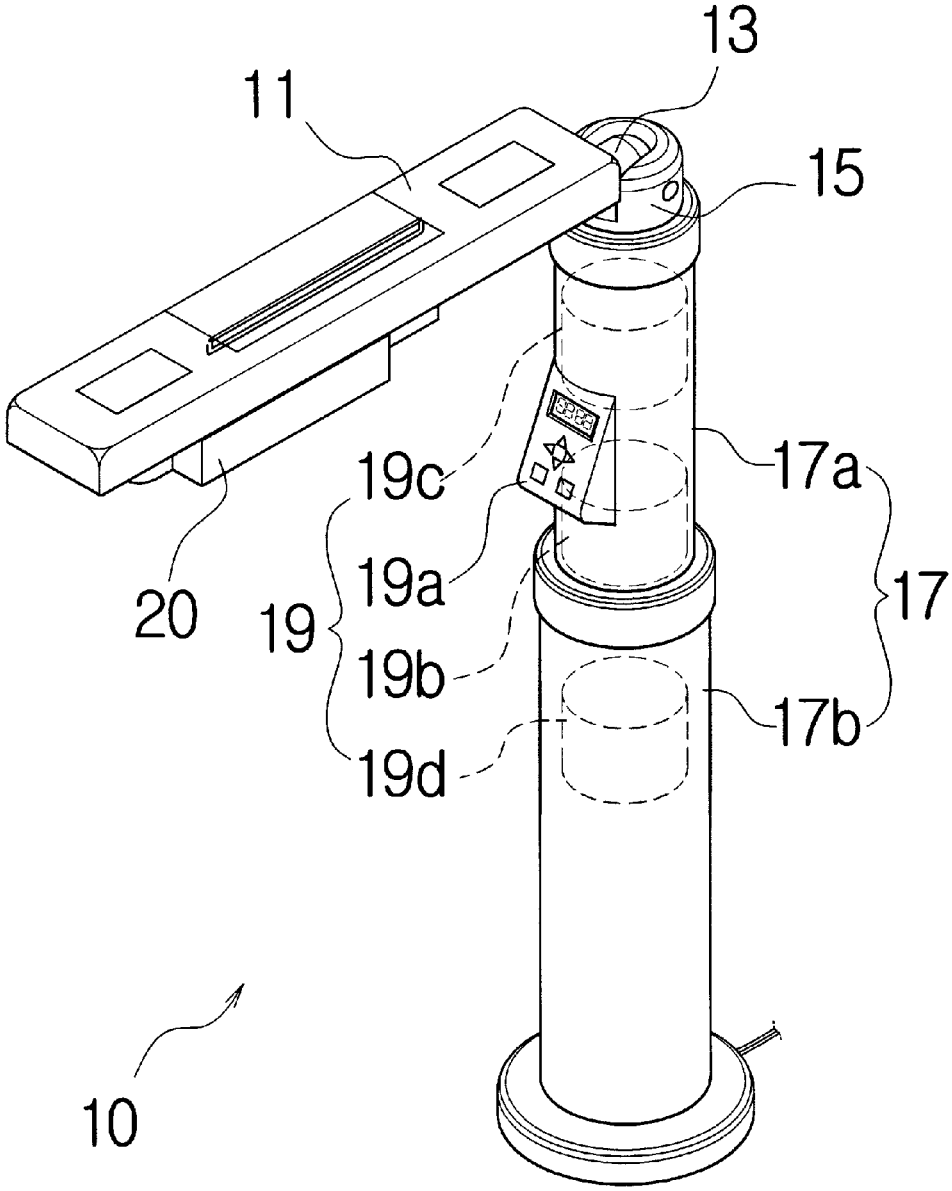
FIG. 2 is a perspective view showing the construction of the upper body support apparatus in a downward rotated state according to the present invention.
Figure 3:
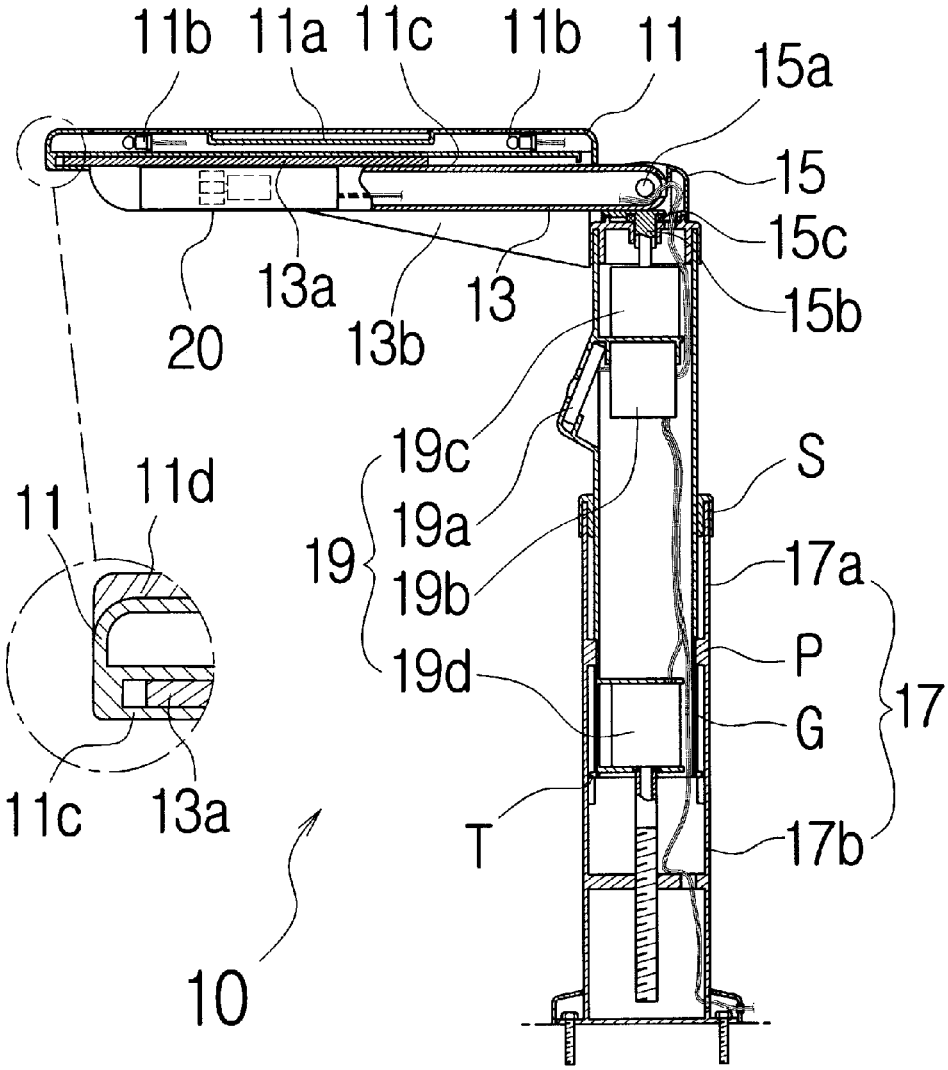
FIG. 3 is a sectional view showing the construction of the upper body support apparatus in the downward rotated state according to the present invention.
Figure 4:
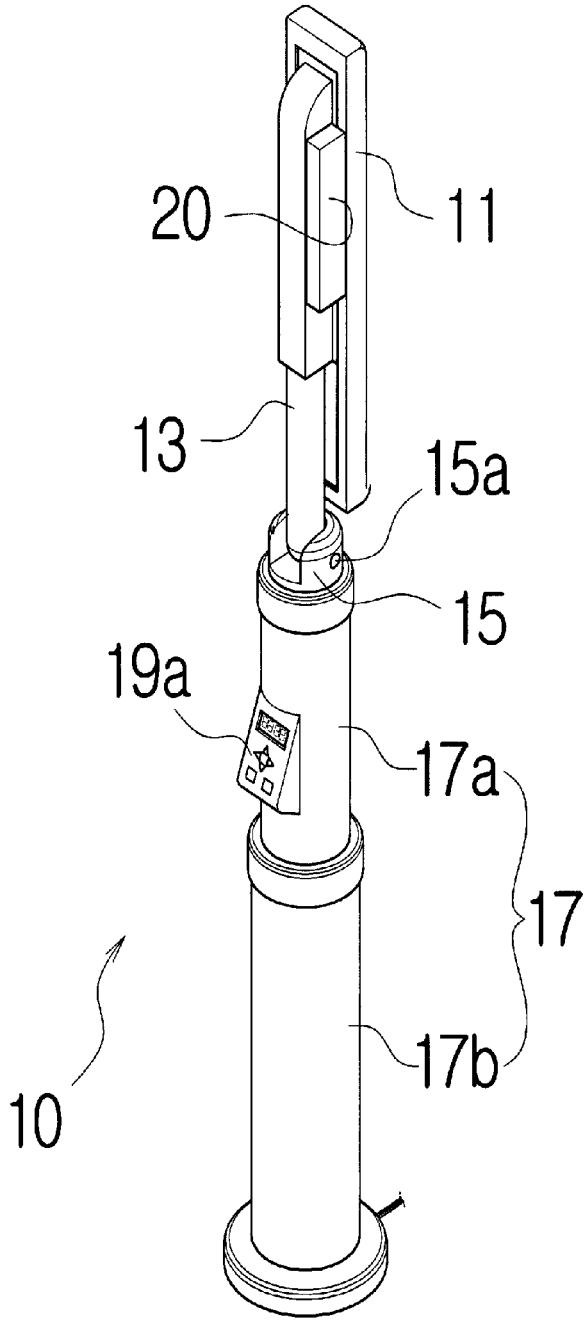
FIG. 4 is a perspective view showing the construction of the upper body support apparatus in an upward rotated state according to the present invention.
Figure 5:
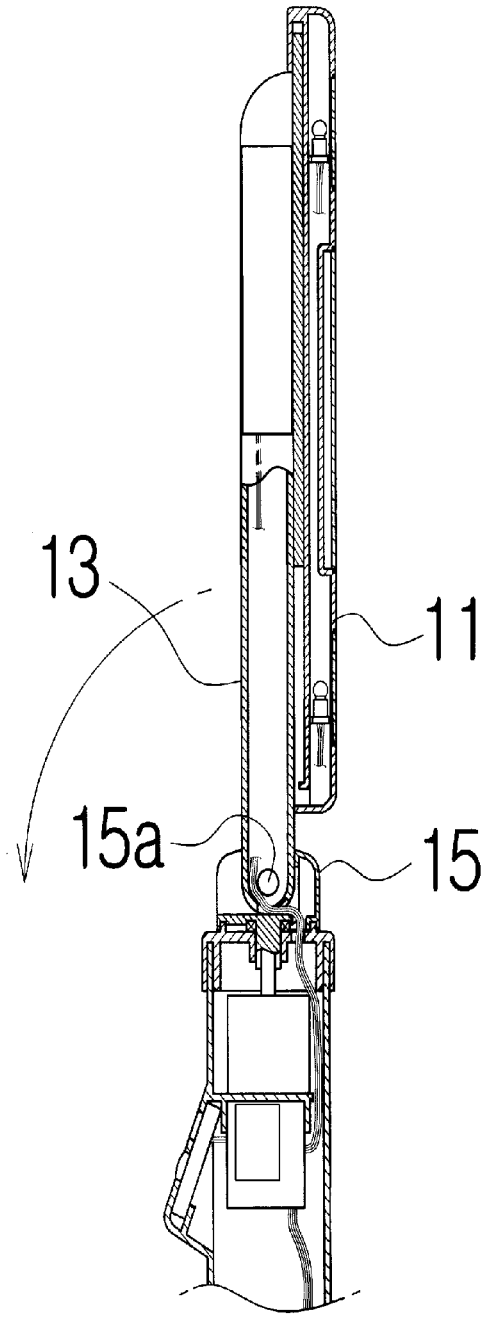
FIG. 5 is a partial sectional view showing the construction of the upper body support apparatus in the upward rotated state according to the present invention.
Figure 6:
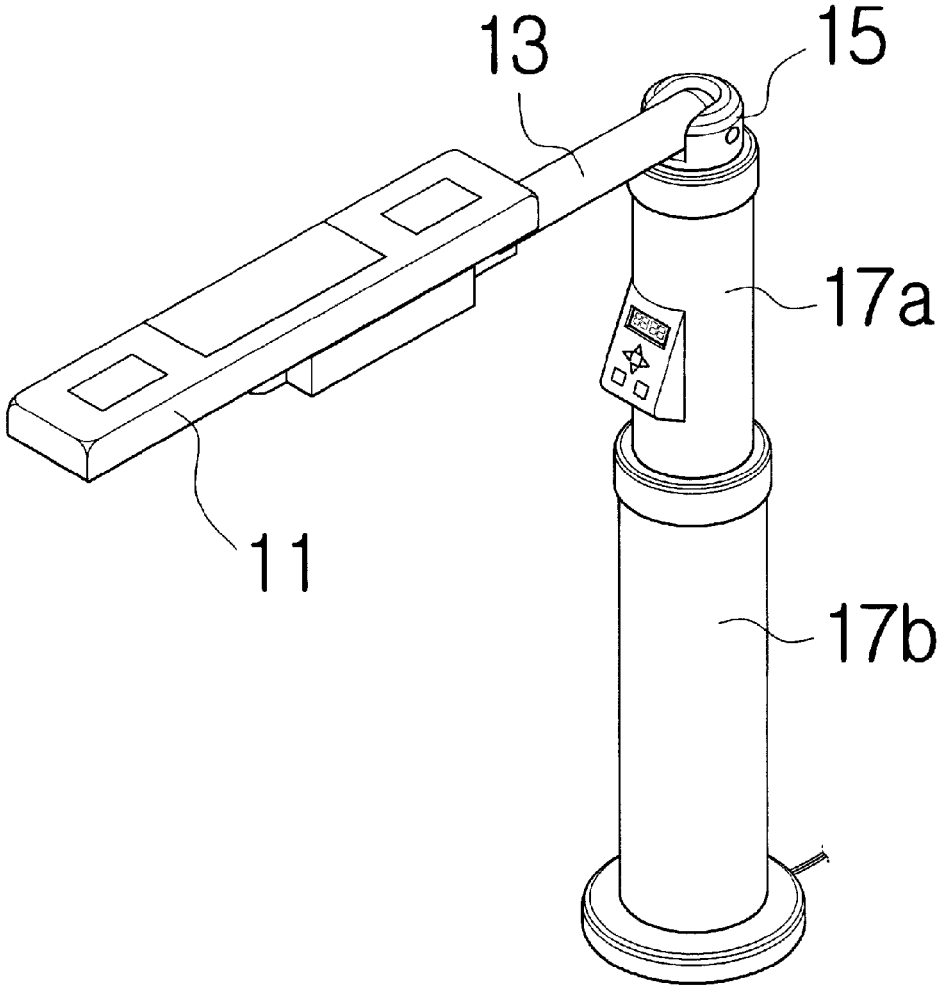
FIG. 6 is a perspective view showing an extended state of a support board of the upper body support apparatus according to the present invention.
Figure 7:
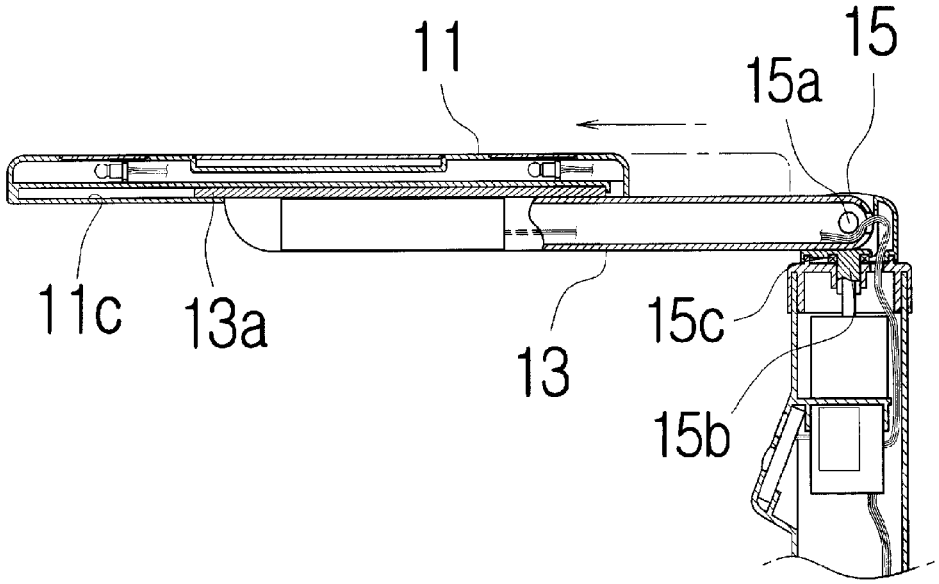
FIG. 7 is a partial sectional view showing the extended state of the support board according to the present invention.
Figure 8:
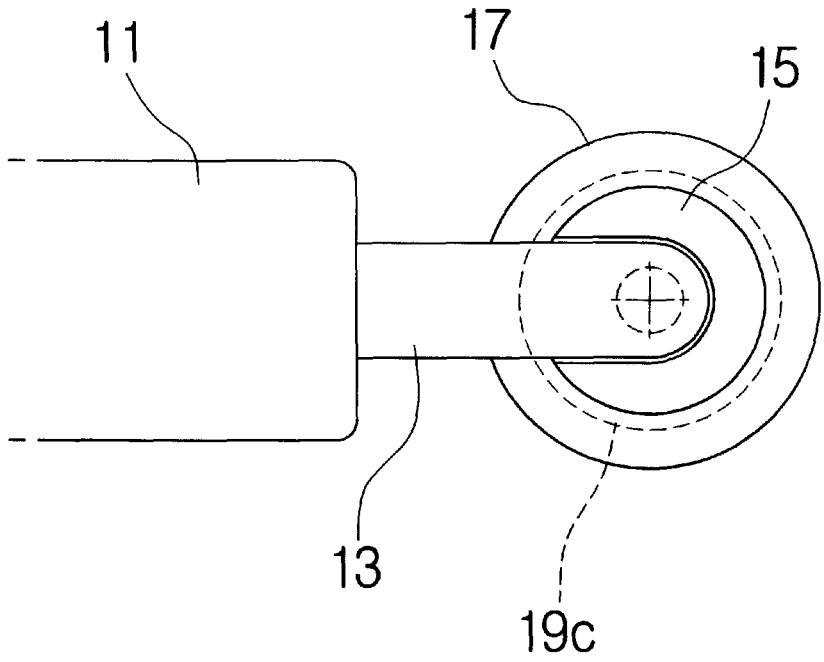
FIGS. 8 and 9 are partial plan views showing the upper plate rotated to the left and the right, respectively, according to the present invention.
Figure 9:
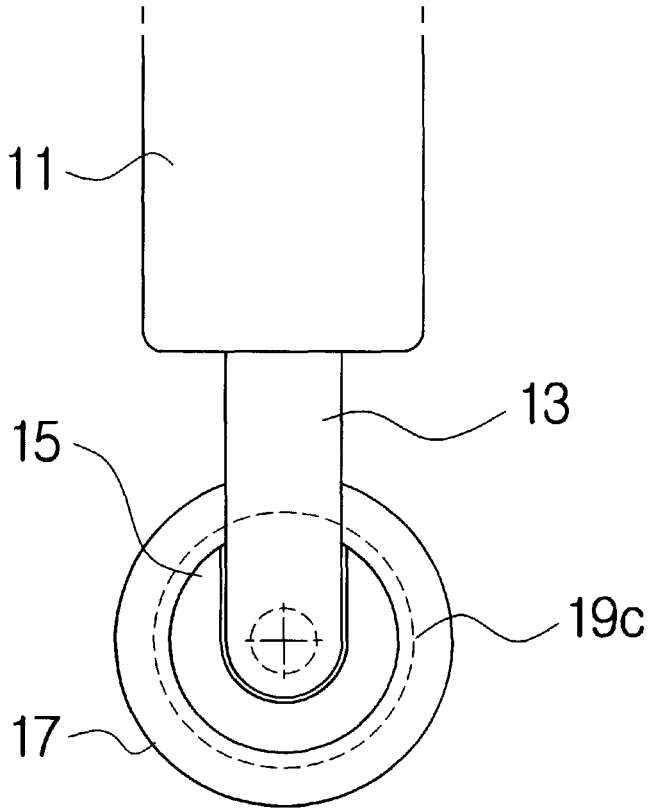
Figure 10:
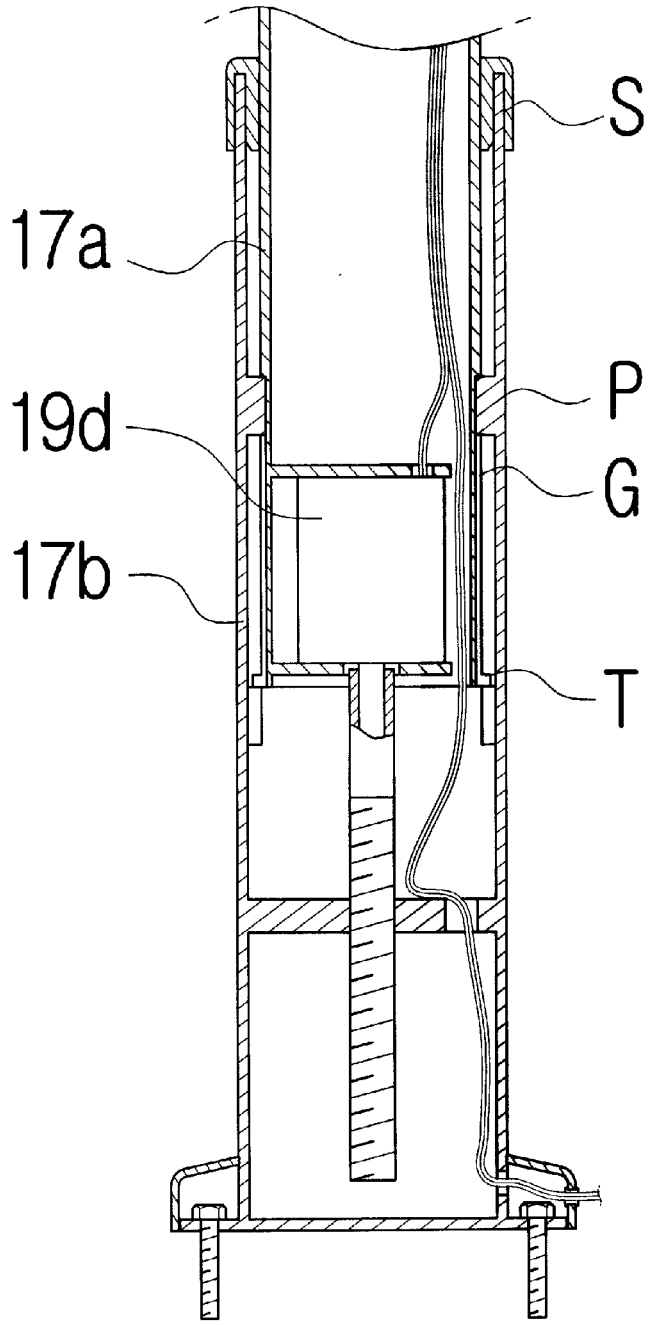
FIGS. 10 through 12 are sectional views showing a vertical frame, which is in a state of being moved upwards or downwards according to the present invention.
Figure 11:
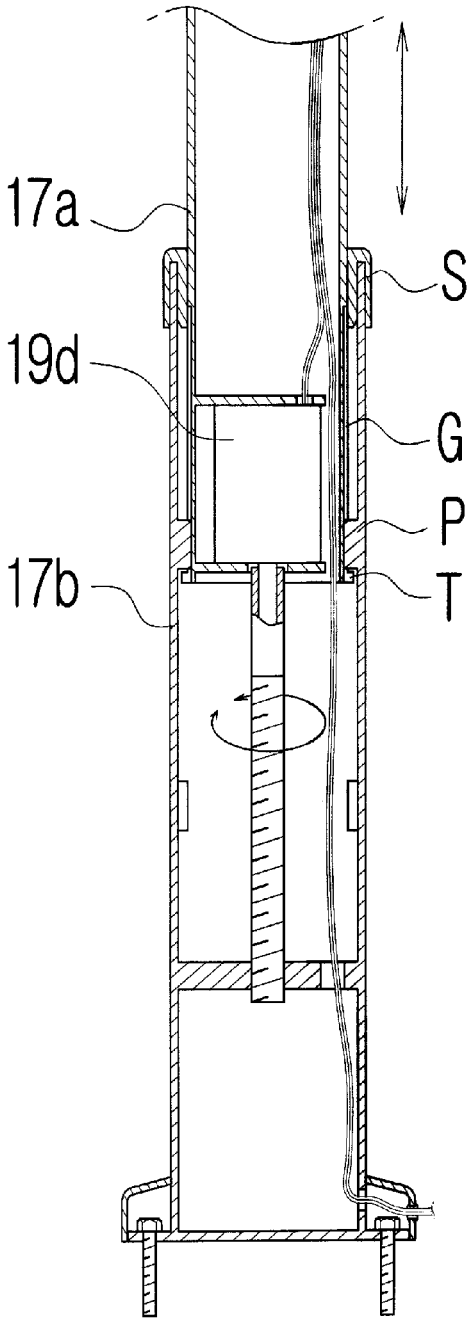
Figure 12:
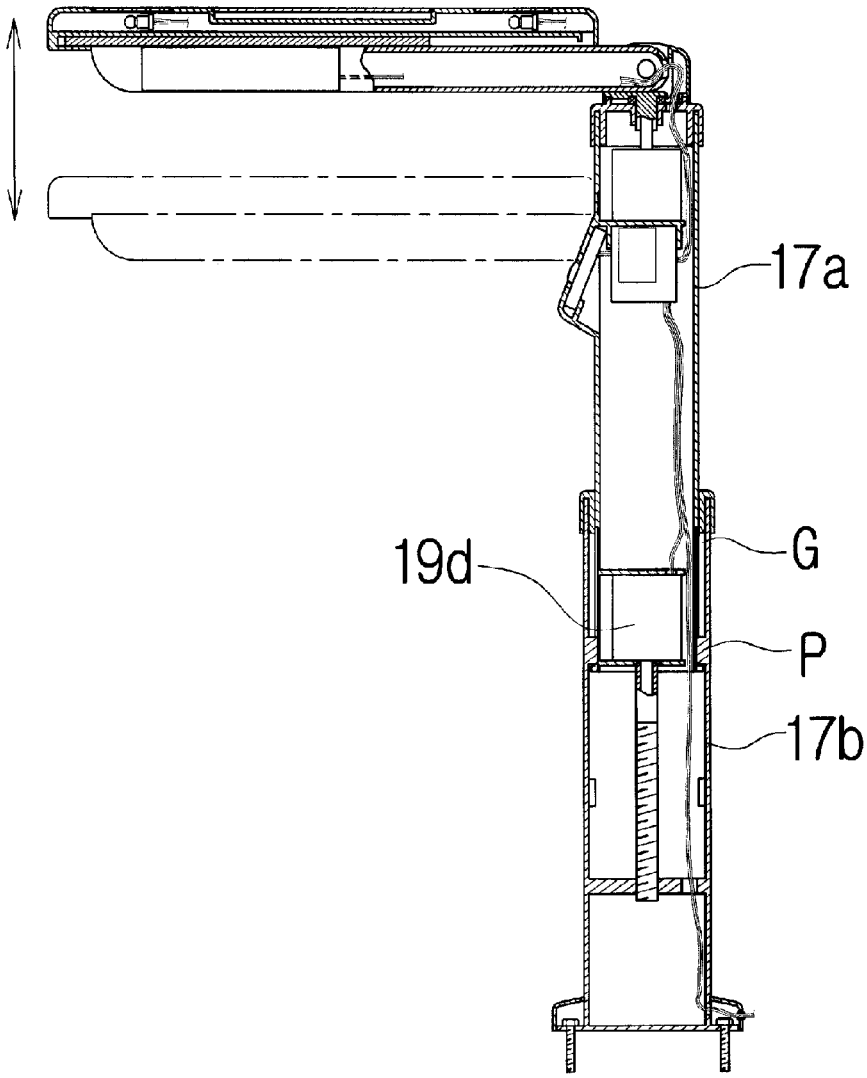
Figure 13:
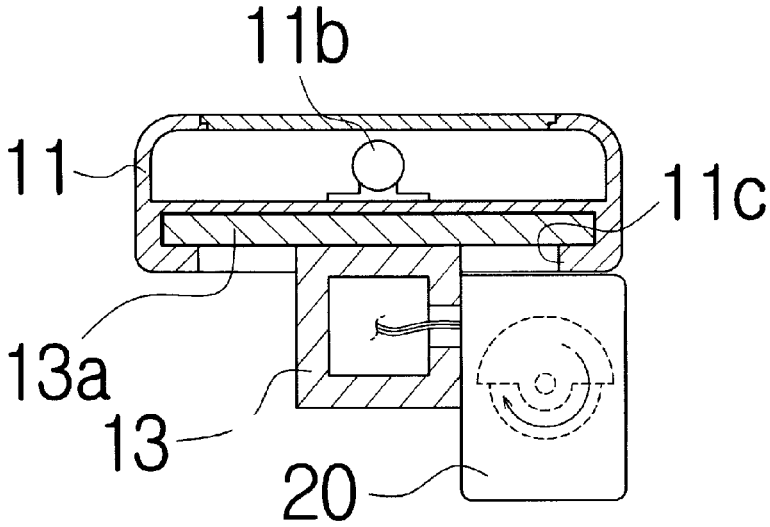
FIG. 13 is a sectional view illustrating a heating/sterilizing unit and a vibrating unit, which are additionally provided in the upper body support apparatus according to the present invention.
Figure 14:
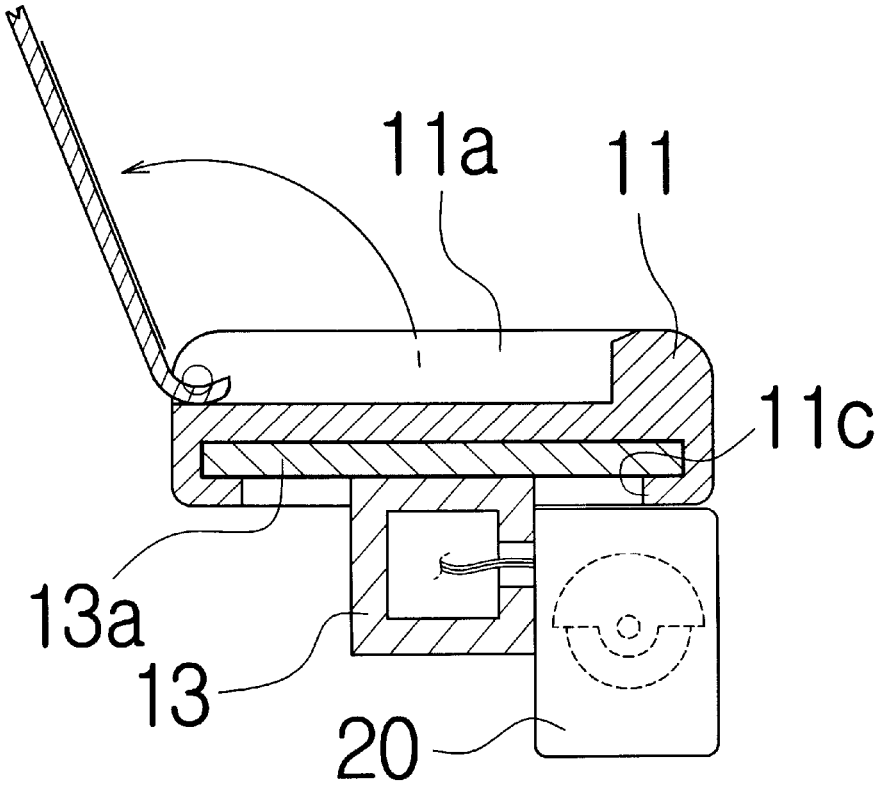
FIG. 14 is a sectional view showing the operation of opening or closing a receptacle of the upper body support apparatus according to the present invention.

FIG. 1 is a perspective view illustrating an upper body support apparatus provided adjacent to a toilet in a lavatory, according to an embodiment of the present invention. FIG. 2 is a perspective view showing the construction of the upper body support apparatus in a downward rotated state according to the present invention. FIG. 3 is a sectional view showing the construction of the upper body support apparatus in the downward rotated state according to the present invention. FIG. 4 is a perspective view showing the construction of the upper body support apparatus in an upward rotated state. FIG. 5 is a partial sectional view showing the construction of the upper body support apparatus in the upward rotated state. FIG. 6 is a perspective view showing an extended state of a support board of the upper body support apparatus. FIG. 7 is a partial sectional view showing the extended state of the support board. FIGS. 8 and 9 are partial plan views illustrating the upper plate rotated to the left and the right, respectively. FIGS. 10 through 12 are sectional views showing a vertical frame, which is in a state of being moved upwards or downwards. FIG. 13 is a sectional view illustrating a heating/sterilizing unit and a vibrating unit, which are additionally provided in the upper body support apparatus. FIG. 14 is a sectional view illustrating the operation of opening or closing a receptacle of the upper body support apparatus.

As shown in FIGS. 1 through 4, the upper body support apparatus 10 according to the present invention is provided at a predetermined position adjacent to a toilet 1 to support the upper body of a user. The upper body support apparatus 10 includes a support board 11, on which the arms of the user are placed, a horizontal shaft 13, which provides a path along which the support board 11 slides relative to the horizontal shaft 13, a hinge unit 15, which supports a first end of the horizontal shaft 13 such that the horizontal shaft 13 is rotatable upwards or downwards within an angular range of 90° around the first end thereof, and a vertical frame 17, which supports the hinge unit 15 and receives therein a drive unit 19, which rotates the hinge unit 15 to the left or the right or moves the hinge unit 15 upwards or downwards in a one-touch button control manner.

In the present invention, a receptacle 11*a*, a cover of which is closed so as to be openable using a hinge, is provided in a medial portion of the upper surface of the support board 11. Transparent windows are disposed in the support board 11 on opposite sides of the receptacle 11*a*. Far infrared lamps 11*b* are provided inside the respective transparent windows. Bent edges 11*c* for guiding the sliding movement of the support board 11 are integrally provided under respective opposite side edges of the lower surface of the support board 11 and extend predetermined lengths in the longitudinal direction. A cushion member 11*d* is adhered to the upper surface of the support board 11.

Here, the far infrared lamps 11*b* serve to emit light and heat outside the apparatus through the transparent windows, thus taking off the chill in the winter.

Furthermore, an ultraviolet lamp may substitute for the far infrared lamp 11*b*. In this case, the transparent windows are preferably made of semitransparent material to partially intercept ultraviolet rays such that the skin of the user is prevented from being injured by excessive exposure to ultraviolet rays.

The bent edges 11*c* correspond to a guide plate 13*a* of the horizontal shaft 13, which will be explained later herein, and thus serve to guide the sliding movement of the support board 11 along with the guide plate 13*a*.

In addition, a substance, which is made of rubber, silicone or sponge and is covered with a leather cover, may be used as the cushion member 11*d*.

Meanwhile, the horizontal shaft 13 is a pipe, which defines therein a space, in which power supply wires for the far infrared lamps 11*b* are placed. The guide plate 13*a*, corresponding to the bent edges 11*c* of the support board 11 to guide the sliding movement of the support board 11, is fastened to the upper surface of the horizontal shaft 13.

Here, the guide plate 13*a* is provided on a second end of the upper surface of the horizontal shaft 13 having the pipe structure, and occupies about ½ of the length of the horizontal shaft 13. Due to this construction, the support board 11, which slides relative to the vertical shaft 13, can be stably extended from the vertical shaft 13 outwards to an appropriate length.

Furthermore, a support block 13*b*, which is a support such as a bracket, is provided under the lower surface of the horizontal shaft 13. The support block 13*b* is brought into contact with the outer surface of the upper end of the vertical frame 17, and thus serves to support the weight of the user, which is applied to the support board 11.

The hinge unit 15 includes a bracket, to which the first end of the horizontal shaft 13 is coupled by a hinge 15*a*, and which is partially cut such that the horizontal shaft 13 is rotated within an angular range of 90°, in other words, between the horizontal direction and the vertical direction. The hinge unit 15 is provided on the lower surface thereof with a support shaft 15*b* and a support bearing 15*c*.

Here, the hinge 15*a* may be coupled to an output shaft of a motor, which is provided outside the hinge unit 15, such that the rotation of the support board 11 can be automatically conducted by manipulation of the user.

Furthermore, the support shaft 15*b* passes through an upper end of an upper frame of the vertical frame 17, which will be explained later herein, and is coupled to an output shaft of a left-right rotating motor, thus serving to transmit left-right rotating force.

The support bearing 15*c* is interposed between the hinge unit 15 and the upper surface of the upper frame of the vertical frame 17 such that the hinge unit 15, which is seated on the upper surface of the upper frame of the vertical frame 17, can be smoothly rotated.

The vertical frame 17 includes the upper frame 17*a*, which supports the hinge unit 15 on the upper end thereof and is provided on the outer surface thereof with a control pad 19*a* having key buttons for controlling the drive unit 19, and a lower frame 17*b*, which is fastened to the floor in the lavatory and supports the upper frame 17*a*, the lower end of which is inserted into the lower frame 17*b*. Here, the lower frame 17*b* supports the upper frame 17*a* such that the upper frame 17*a* is movable only in the vertical direction, without rotating relative to the lower frame 17*b*.

To achieve this purpose, a guide groove G is formed in the circumferential outer surface of the upper frame 17*a* and extends from the lower end of the upper frame 17*a* to the medial portion thereof. A guide protrusion P defining a path along which the guide groove G is moved upwards or downwards is provided in the lower frame 17*b*.

Then, when a motor for moving the upper frame 17*a* upwards or downwards relative to the lower frame 17*b* is operated, the upper frame 17*a* can be moved only upwards or downwards, without undesirably rotating.

Furthermore, a stop ring T is provided on the lower end of the upper frame 17*a*. A stopper S is provided on the upper end of the lower frame 17*b* to prevent the stop ring T from being undesirably removed from the lower frame 17*b*. The stopper S may be an annular cap, which is fitted over the upper end of the lower frame 17*b*.

Due to this construction, even if the upper frame 17*a* is excessively moved upwards, it is prevented from being removed from the lower frame 17*b*. Furthermore, the lower frame 17*b* can support the upper frame 17*a* such that the upper frame 17*a* slides upwards or downwards along the circumferential inner surface of the lower frame 17*b* without undesirably moving.

Meanwhile, the drive unit 19 includes a control means 19*b*, which conducts the operation, corresponding to a command selected by manipulating the key buttons of the control pad 19*a*, using power transmitted from the outside, and the left-right rotating motor 19*c*, which is reversibly rotated to rotate the hinge unit 15 to the left or the right in response to an operating signal transmitted from the control means 19*b*. The drive unit 19 further includes the lift motor 19*d*, which is reversibly rotated to move the lower frame 17*b* upwards or downwards in response to an operating signal transmitted from the control means 19*b*.

Preferably, the left-right rotating motor 19*c* is installed in the upper end of the upper frame 17*a*, and the lift motor 19*d* is installed in the lower end of the upper frame 17*a*.

Furthermore, a lead screw having an external thread is used as the output shaft of the lift motor 19*d*, and is constructed such that it is inserted through a support plate, which is provided in the lower end of the lower frame 17*b*, so as to be rotatable in a screwrotating manner. Here, the support plate is fastened to the circumferential inner surface of the lower frame 17*b*, and the central portion thereof is fitted over the output shaft of the lift motor 19*d* so as to be rotatable in a screw-coupling manner.

In the present invention having the above-mentioned construction, as shown in FIG. 5, when the user sits on the toilet and rotates the support board 11, which is disposed at a position adjacent to the toilet, downwards to the front of the upper body of the user, the first end of the horizontal shaft 13, which is hinged to the hinge unit 15, is rotated around the hinge unit 15. Then, the support board 11, which is slidably coupled to the horizontal shaft 13, is oriented in the horizontal direction in the front of the upper body of the user.

Therefore, as shown in FIGS. 6 and 7, when the support board 11 is pulled in the direction away from the horizontal shaft 13, the support board 11 is extracted from the horizontal shaft 13, that is, the length thereof is extended, under the guidance of the bent edges 11*c* of the support board 11, which slide relative to the guide plate 13*a* of the horizontal shaft 13.

Here, the length extension can be appropriately adjusted to suit the body type of the user.

After the support board 11 is moved to the front of the upper body of the user, if the user does not want to support his/her upper body on the support board 11, or, if the user does not want to use the support board 11 for a while in order to conduct other routine work, the support board 11 can be rotated in the horizontal direction towards the wall in the lavatory by manipulating left-right rotating control buttons, which are provided on the control pad 19*a* of the drive unit 19.

In detail, as shown in FIGS. 8 and 9, when the left rotating control button of the control pad 19*a* of the drive unit 19 are pushed, the left-right rotating motor 19*c* is rotated in the normal direction, so that the support board 11 is rotated in the horizontal direction towards the wall in the lavatory. When it is desired to use the support board 11 again, the right rotating control button is pushed. Then, the left-right rotating motor 19*c* is reversely rotated, so that the support board 11 is rotated towards the user, thus enabling the user to use the support board 11.

Furthermore, as shown in FIGS. 10 through 12, to match the sitting height of the user, for example, in the case where the sitting height of the user is relatively high, when a corresponding button among vertical control buttons, which are provided on the control pad 19*a* of the drive unit 19, is pushed, the lift motor 19*d* is rotated in the normal direction. Then, the upper frame 17*a* has a tendency to rotate relative to the lower frame 17*b*, to which the output shaft of the lift motor 19*d* is rotatably screwed, but, because the guide protrusion P of the lower frame 17*b* is placed in the guide groove G in the upper frame 17*a*, the upper frame 17*a* is moved upwards without rotating relative to the lower frame 17*b*.

In the case where the sitting height of the user is relatively low, when a corresponding button of the vertical control buttons of the control pad 19*a* of the drive unit 19 is pushed, the lift motor 19*d* is reversely rotated. Then, the upper frame 17*a* is moved downwards without rotating relative to the lower frame 17*b* by the same principle as that in the description of the upward movement of the upper frame 17*a*.

In the present invention, even if no drive signal is transmitted from the control means 19*b* to the left-right rotating motor 19*c* or the lift motor 19*d*, particularly, even if no power is applied thereto, the apparatus can be operated by a manual method. Moreover, because a reserve charging battery for supplying emergency power is provided in the control means 19*b*, even in emergency conditions, such as during a power failure, the apparatus can be operated for some time.

Furthermore, as described above, referring to FIG. 13, the receptacle 11*a* having the openable cover may be provided in the medial portion of the upper surface of the support board 11. The far infrared lamps 11*b* may be provided inside the respective transparent windows, which are disposed in the support board 11 on opposite sides of the receptacle 11*a*.

In this case, the far infrared lamps 11*b* emit heat, as well as far infrared rays, which are beneficial to the human body, through the transparent windows, thus taking off the chill in the winter. Here, an ultraviolet lamp may substitute for the far infrared lamp 11*b*. In this case, the transparent windows preferably have a function of partially intercepting ultraviolet rays, thus preventing the skin of the user from being injured by excessive exposure to ultraviolet rays.

Furthermore, the present invention may further include a vibration unit 20, which is provided under the lower surface of the support board 11 at a position adjacent to the user. In this case, the present invention can have a function of massaging the abdomen of the user. That is, the user brings his/her abdomen into contact with the vibration unit 20 and pushes a control button of the control pad 19*a* corresponding to the vibration unit 20. Then, the vibration unit 20 massages the abdomen of the user. In particular, in the case of a constipated user, the vibration unit 20 stimulates the large intestine of the user, thus enabling easy evacuation of the bowels.

Here, the vibration unit 20 may be coupled to the support board 11 in a fitting manner or a screw coupling manner. As well, the vibration unit 20 may be constructed such that the inclination angle thereof relative to the forward direction can be adjusted.

Furthermore, the vibration unit 20 may comprise a device, which vibrates using the rotation of a motor, which is connected to a power wire that extends into the horizontal shaft 13 having the pipe structure. Here, the vibration of the vibration unit 20 using the rotation of the motor may be realized by rotation of an eccentric body.

In consideration of the movement of the power wire connected to the vibration unit 20 due to the sliding movement of the support board 11 relative to the horizontal shaft 13, it is preferable that a slot, through which the power wire is extracted from the horizontal shaft 13, be formed in the horizontal shaft 13.

Furthermore, the cover of the receptacle 11*a* is preferably constructed such that a book can be supported on the cover. In addition, various objects of the user can be contained in the receptacle 11*a* so that they are prevented from falling from the support board 11.

Although the preferred embodiment of the present invention has been disclosed for illustrative purposes, the present invention is not limited to the construction and operation of the illustrated embodiment. Those skilled in the art will appreciate that various modifications, additions and substitutions are possible, without departing from the scope and spirit of the invention as disclosed in the accompanying claims.

Therefore, such modifications, additions and substitutions must also be regarded as falling within the bounds of the present invention.

INDUSTRIAL APPLICABILITY

As described above, an upper body support apparatus of the present invention enables a user to place his/her arms on a support board while having a bowel movement, thus maintaining correct posture such that the upper body of the user is prevented from leaning too far forwards, thereby preventing an increase in blood pressure attributable to the bowel movement.

Furthermore, under normal conditions, the support board can be placed adjacent to a wall in an upright state or in a horizontal state. Hence, in a lavatory having limited space, free movement of the user is ensured, and the upper body support apparatus is prevented from impeding the opening or closing of a door of the lavatory.

As well, in the present invention, the support board can be automatically rotated downwards or upwards, and is thus opened or closed by manipulating control buttons in the one-touch button control manner. Therefore, even the old and the weak can easily use the upper body support apparatus.

Furthermore, a heat generating means or a sterilization means is provided in the support board, thus enabling maintenance of the body temperature of the user in the winter, and improving personal sanitation in a lavatory in which it is hard to continuously maintain a sanitary state.

In addition, in the case where the upper body support apparatus of the present invention is used for the old and the weak, in particular, the old, having poor metabolism, the upper body support apparatus of the present invention can promote the bowel movement, thus guiding smooth bowel evacuation.

Moreover, the present invention enables the user to place his/her arms thereon and, as well, enables a book or cosmetics to be placed thereon, thus making it possible to conduct other routine work as well as the bowel evacuation.

The invention claimed is:

1. An upper body support apparatus for toilets provided at a predetermined position adjacent to a toilet in a lavatory to support an upper body of a user who sits on the toilet, the upper body support apparatus comprising:

a support board configured to support arms of the user thereon;

a horizontal shaft providing a path, along which the support board slides relative to the horizontal shaft;

a hinge unit supporting a first end of the horizontal shaft such that the horizontal shaft is rotatable upwards or downwards within an angular range of 90° around the first end thereof;

a vertical frame supporting the hinge unit and receiving therein a drive unit, which rotates the hinge unit to a left or a right or moves the hinge unit upwards or downwards in a one-touch button control manner, and a vibration unit provided under a lower surface of the support board at a position adjacent to the user.

2. The upper body support apparatus according to claim 1, wherein the support board comprises far infrared lamps provided inside respective transparent windows, which are disposed in respective opposite ends of a surface of the support board.

3. The upper body support apparatus according to claim 1, wherein the support board comprises near infrared lamps provided inside respective transparent windows, which are disposed in respective opposite ends of a surface of the support board.

4. The upper body support apparatus according to claim 1, wherein the support board comprises ultraviolet lamps provided inside respective transparent windows, which are disposed in respective opposite ends of a surface of the support board.

5. The upper body support apparatus according to claim 4, wherein each of the transparent windows is made of a semi-transparent material.

6. The upper body support apparatus according to claim 1, wherein bent edges guiding sliding movement of the support board are integrally provided under respective opposite side edges of a lower surface of the support board and extend predetermined lengths in a longitudinal direction of the support board.

7. The upper body support apparatus according to claim 1, wherein a receptacle is provided in a medial portion of an upper surface of the support board, the receptacle being covered with a cover so as to be openable using a hinge, and wherein a cushion member is adhered to the upper surface of the support board.

8. The upper body support apparatus according to claim 1, wherein the vibration unit comprises a device, which vibrates using rotation of a motor connected to a power wire that extends into the horizontal shaft.

9. The upper body support apparatus according to claim 8, wherein the vibration of the vibration unit using the rotation of the motor is conducted by rotation of an eccentric body.

10. The upper body support apparatus according to claim 1, wherein the horizontal shaft has a pipe shape having therein a space, in which power supply wires for the far infrared lamps are placed, the horizontal shaft being provided on an upper surface thereof with a guide plate corresponding to the bent edges of the support board to guide sliding movement of the support board.

11. The upper body support apparatus according to claim 10, wherein the guide plate is provided on a second end of the upper surface of the horizontal shaft and occupies ½ of a length of the horizontal shaft.

12. The upper body support apparatus according to claim 1, wherein a support block is provided under a lower surface of the horizontal shaft, the support block being brought into contact with an outer surface of an upper end of the vertical frame to support a weight of the user applied to the support board.

13. The upper body support apparatus according to claim 1, wherein the hinge unit comprises a bracket, to which the first end of the horizontal shaft is coupled by a hinge, the bracket being partially cut such that the horizontal shaft is rotated within an angular range of 90° between a horizontal direction and a vertical direction, with a support shaft and a support bearing provided under a lower surface of the bracket.

14. The upper body support apparatus according to claim 13, wherein the hinge is coupled to an output shaft of a motor, which is mounted to an outer surface of the hinge unit.

15. An upper body support apparatus for toilets provided at a predetermined position adjacent to a toilet in a lavatory to support an upper body of a user who sits on the toilet, the upper body support apparatus comprising:

a support board configured to support arms of the user thereon;

a horizontal shaft providing a path, along which the support board slides relative to the horizontal shaft;

a hinge unit supporting a first end of the horizontal shaft such that the horizontal shaft is rotatable upwards or downwards within an angular range of 90° around the first end thereof; and a vertical frame supporting the hinge unit and receiving therein a drive unit, which rotates the hinge unit to a left or a right or moves the hinge unit upwards or downwards in a one-touch button control manner, wherein the vertical frame comprises:

an upper frame supporting the hinge unit on an upper end thereof; and a lower frame fastened to a floor in the lavatory, the lower frame-f supporting the upper frame, a lower end of which is inserted into the lower frame, wherein the lower frame supports the upper frame such that the upper frame is movable in a vertical direction and is prevented from rotating relative to the lower frame.

16. The upper body support apparatus according to claim 15, wherein a guide groove is formed in a circumferential outer surface of the upper frame and extends from a lower end of the upper frame to the medial portion thereof, and a guide protrusion is provided in the lower frame to define a path, along which the guide groove is moved upwards or downwards.

17. The upper body support apparatus according to claim 15, wherein a stop ring is provided on the lower end of the upper frame, and a stopper is provided on an upper end of the lower frame to prevent the stop ring from being removed from the lower frame.

18. The upper body support apparatus according to claim 17, wherein the stopper comprises an annular cap fitted over the upper end of the lower frame.

19. An upper body support apparatus for toilets provided at a predetermined position adjacent to a toilet in a lavatory to support an upper body of a user who sits on the toilet, the upper body support apparatus comprising:

a support board configured to support arms of the user thereon;

a horizontal shaft providing a path, along which the support board slides relative to the horizontal shaft;

a hinge unit supporting a first end of the horizontal shaft such that the horizontal shaft is rotatable upwards or downwards within an angular range of 90° around the first end thereof; and a vertical frame supporting the hinge unit and receiving therein a drive unit, which rotates the hinge unit to a left or a right or moves the hinge unit upwards or downwards in a one-touch button control manner, wherein the drive unit comprises:

a control means to conduct an operation corresponding to a command selected by manipulating key buttons of a control pad, using power transmitted from an outside;

a left-right rotating motor rotated reversibly to rotate the hinge unit to a left or a right in response to an operating signal transmitted from the control means; and a lift motor rotated reversibly to move an upper frame of the vertical frame upwards or downwards relative to the lower frame of the vertical frame in response to an operating signal transmitted from the control means.

20. The upper body support apparatus according to claim 19, wherein the left-right rotating motor is installed in an upper end of the upper frame, and the lift motor is installed in a lower end of the upper frame.

21. The upper body support apparatus according to claim 19, wherein an output shaft of the lift motor comprises a lead screw having an external thread.

22. The upper body support apparatus according to claim 20, wherein the output shaft of the lift motor is inserted through a support plate, provided in the lower end of the lower frame, so as to be rotatable in a screw-rotation manner.

* * * * *